US010835024B1

(12) United States Patent
Kostro

(10) Patent No.: US 10,835,024 B1
(45) Date of Patent: Nov. 17, 2020

(54) TOUCHUP PAINT APPLICATOR SYSTEM

(71) Applicant: Julie Kostro, Odenton, MD (US)

(72) Inventor: Julie Kostro, Odenton, MD (US)

( * ) Notice: Subject to any disclaimer, the term of this patent is extended or adjusted under 35 U.S.C. 154(b) by 0 days.

(21) Appl. No.: 16/417,747

(22) Filed: May 21, 2019

(51) Int. Cl.

| | |
|---|---|
| ***B05C 17/005*** | (2006.01) |
| ***B08B 1/00*** | (2006.01) |
| ***B25G 1/10*** | (2006.01) |
| ***A46B 11/00*** | (2006.01) |
| ***A46B 9/00*** | (2006.01) |

(52) U.S. Cl.
CPC ..... *A46B 9/005* (2013.01); *A46B 11/0075* (2013.01); *B05C 17/00586* (2013.01); *B08B 1/006* (2013.01); *B25G 1/102* (2013.01)

(58) Field of Classification Search
CPC ... B05C 17/00; B05C 17/00586; B08B 1/006; B08B 1/00; B08B 1/007; B25G 1/102; A46B 11/0075; A46B 9/005
See application file for complete search history.

(56) References Cited

U.S. PATENT DOCUMENTS

| | | | | |
|---|---|---|---|---|
| 3,399,020 | A * | 8/1968 | Margolis | A45D 34/042 401/135 |
| 3,786,820 | A * | 1/1974 | Kopfer | A45D 29/04 132/74.5 |
| 3,811,783 | A | 5/1974 | Johnson | |
| 4,594,015 | A | 6/1986 | Pomares | |
| D392,433 | S | 3/1998 | Norris | |
| 6,729,786 | B1 * | 5/2004 | Tufts | A45D 34/04 401/132 |
| 7,040,828 | B2 | 5/2006 | LaPointe | |
| 7,261,701 | B2 * | 8/2007 | Davis | A61M 35/006 604/3 |
| 7,727,175 | B2 * | 6/2010 | Voegele | A61F 15/005 401/132 |
| 8,834,054 | B2 | 9/2014 | Gallardo | |
| 2005/0049538 | A1 | 3/2005 | Trevillot | |

FOREIGN PATENT DOCUMENTS

| | | |
|---|---|---|
| WO | 0037183 | 6/2000 |

* cited by examiner

*Primary Examiner* — David J Walczak
(74) *Attorney, Agent, or Firm* — Kyle A. Fletcher, Esq.

(57) ABSTRACT

The touchup paint applicator system includes a paint capsule, an activator, a sponge, and a handle. The sponge may be operative to clean a surface. As a non-limiting example, the surface may be a wall. The activator may be pressed to pierce the paint capsule, located within a cavity inside of the handle. The pierced paint capsule may release paint into the sponge. Released paint may be applied to the surface by placing the sponge, soaked with the released paint, against the surface. The handle may hinge open to provide access to the paint capsule.

17 Claims, 5 Drawing Sheets

TOUCHUP PAINT APPLICATOR SYSTEM

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the fields of cleaning products and paint applicators, more specifically, a touchup paint applicator system.

SUMMARY OF INVENTION

In embodiments, the touchup paint applicator system may comprise a paint capsule, an activator, a sponge, and a handle. The sponge may be operative to clean a surface. As a non-limiting example, the surface may be a wall. The activator may be pressed to pierce the paint capsule, located within a cavity inside of the handle. The pierced paint capsule may release paint into the sponge. Released paint may be applied to the surface by placing the sponge, soaked with the released paint, against the surface. The handle may hinge open to provide access to the paint capsule.

An object of the invention is to provide a tool for cleaning a surface and applying paint to the surface using a sponge.

Another object of the invention is to deliver the paint inside of a capsule contained within a cavity of a handle.

A further object of the invention is to provide an activator that may pierce the capsule to release the paint into the sponge.

Yet another object of the invention is to provide a hinge on the handle that allows a lid of the handle to pivot away from a body of the handle to provide access to the paint capsule.

These together with additional objects, features and advantages of the touchup paint applicator system will be readily apparent to those of ordinary skill in the art upon reading the following detailed description of the presently preferred, but nonetheless illustrative, embodiments when taken in conjunction with the accompanying drawings.

In this respect, before explaining the current embodiments of the touchup paint applicator system in detail, it is to be understood that the touchup paint applicator system is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the touchup paint applicator system.

It is therefore important that the claims be regarded as including such equivalent construction insofar as they do not depart from the spirit and scope of the touchup paint applicator system. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description. As used herein, the word "or" is intended to be inclusive.

Figure 1:
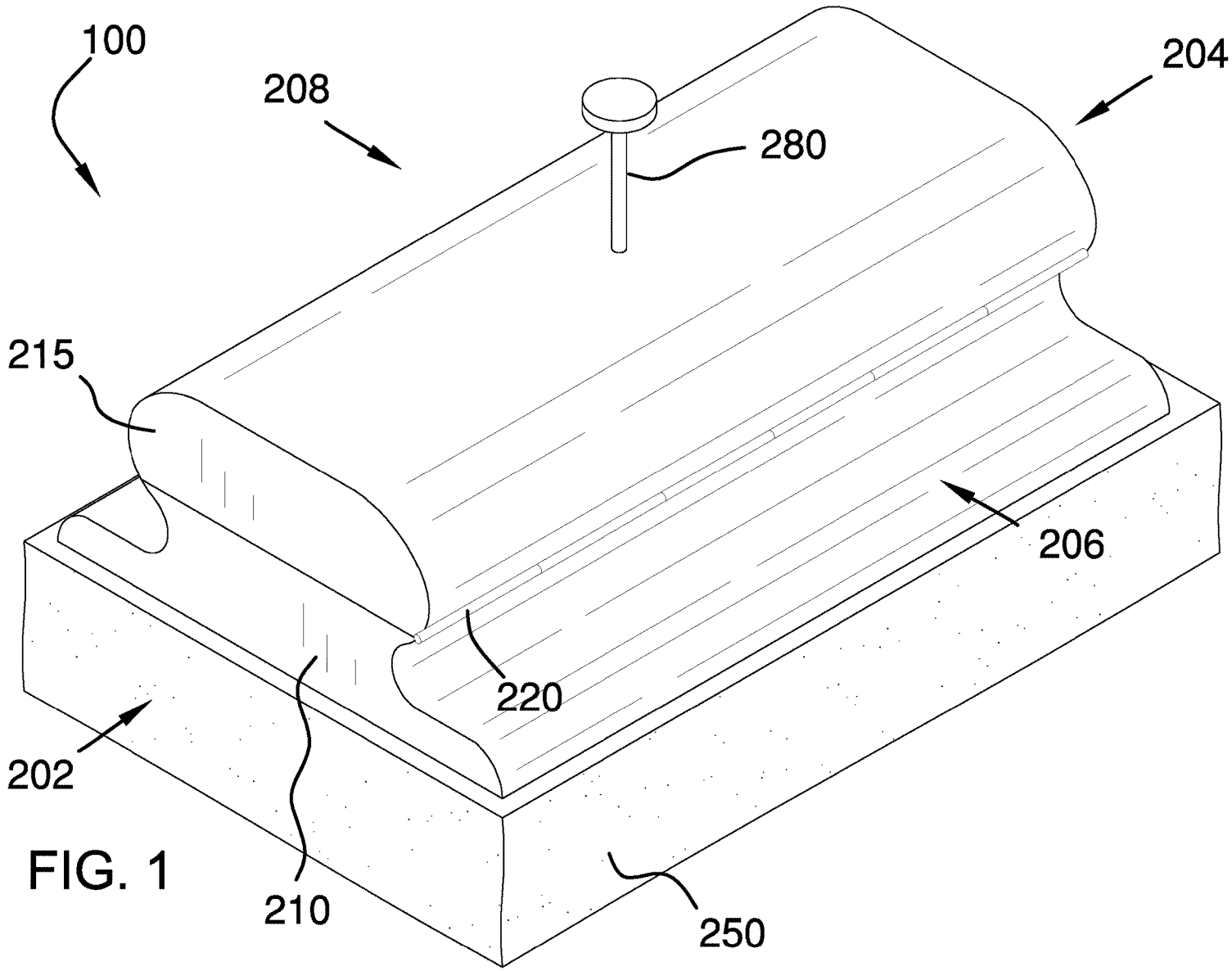
FIG. 1 is a perspective view of an embodiment of the disclosure.
Figure 2:
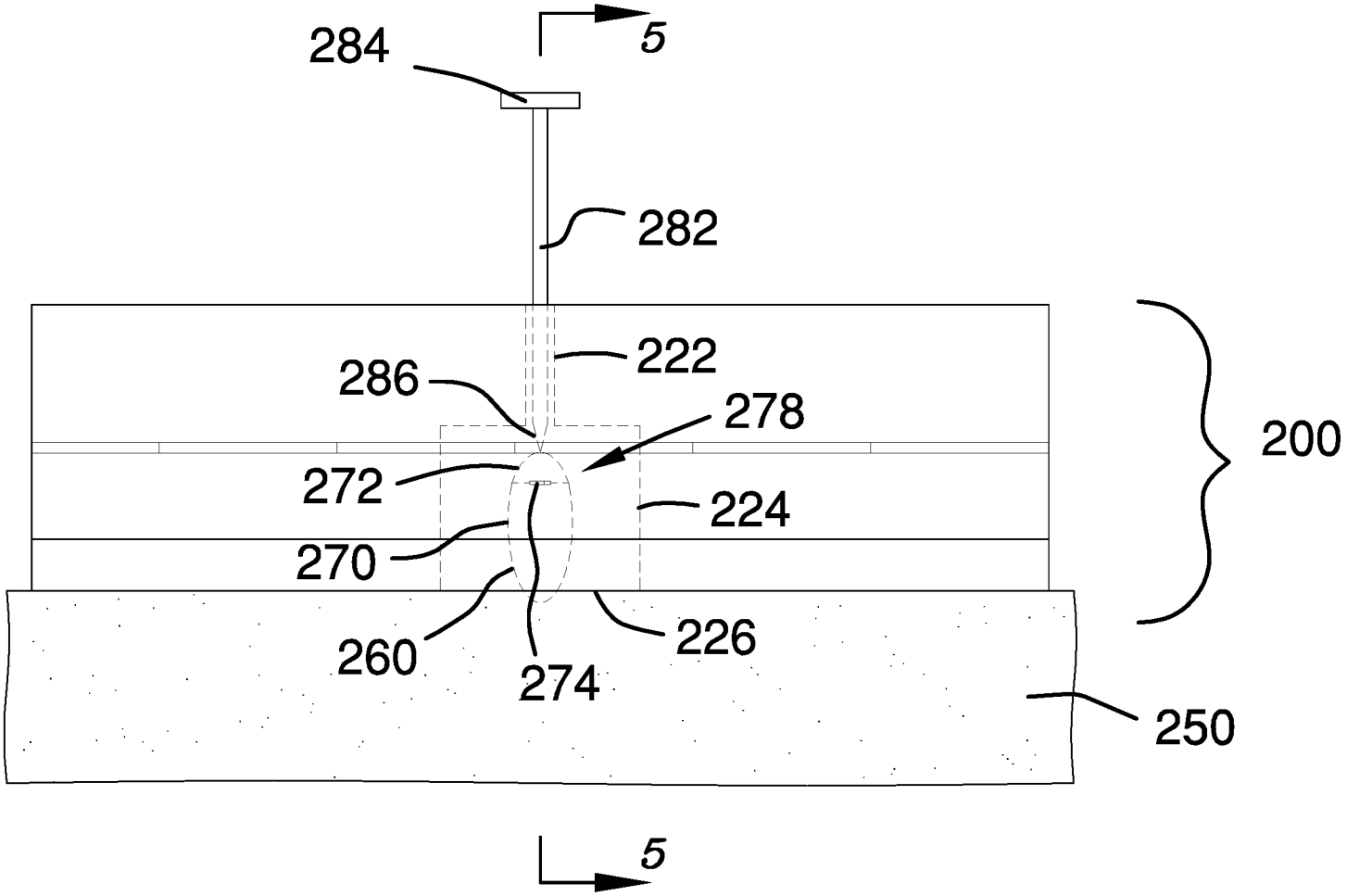
FIG. 2 is a front view of an embodiment of the disclosure.
Figure 3B:
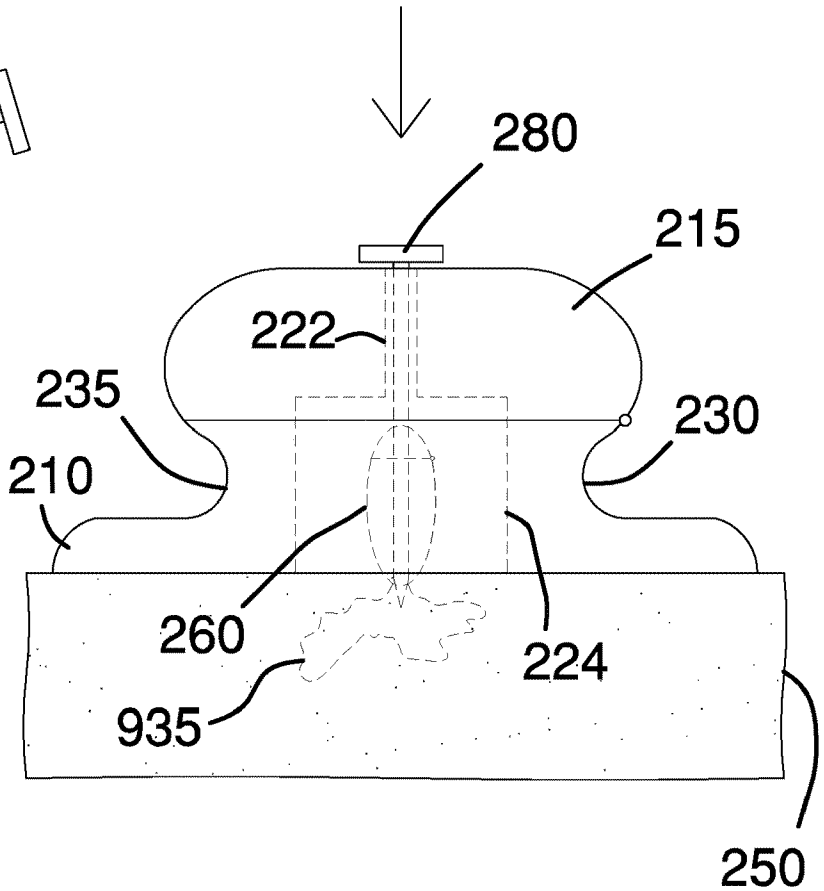
FIG. 3*b* is a side view of an embodiment of the disclosure illustrating the lid pivoted to the second position and the activator pressed to piece the paint capsule.
Figure 3A:
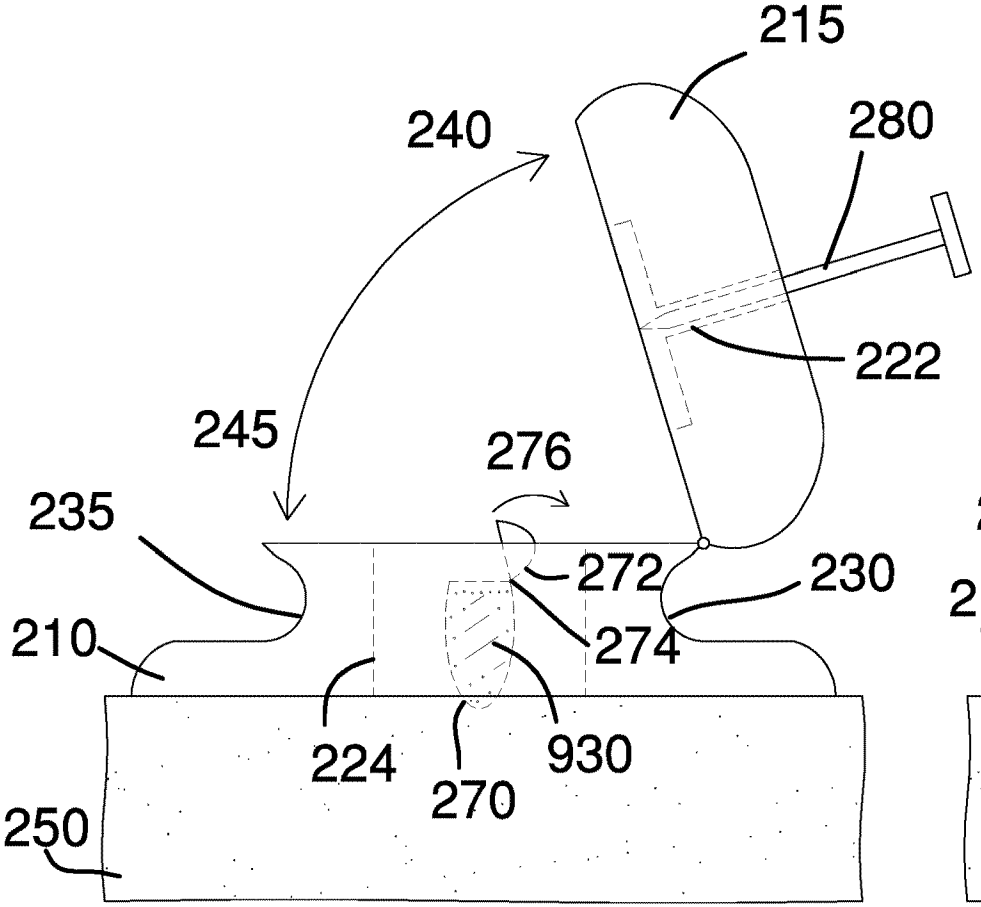
FIG. 3*a* is a side view of an embodiment of the disclosure illustrating the lid pivoted to the first position.
Figure 4:
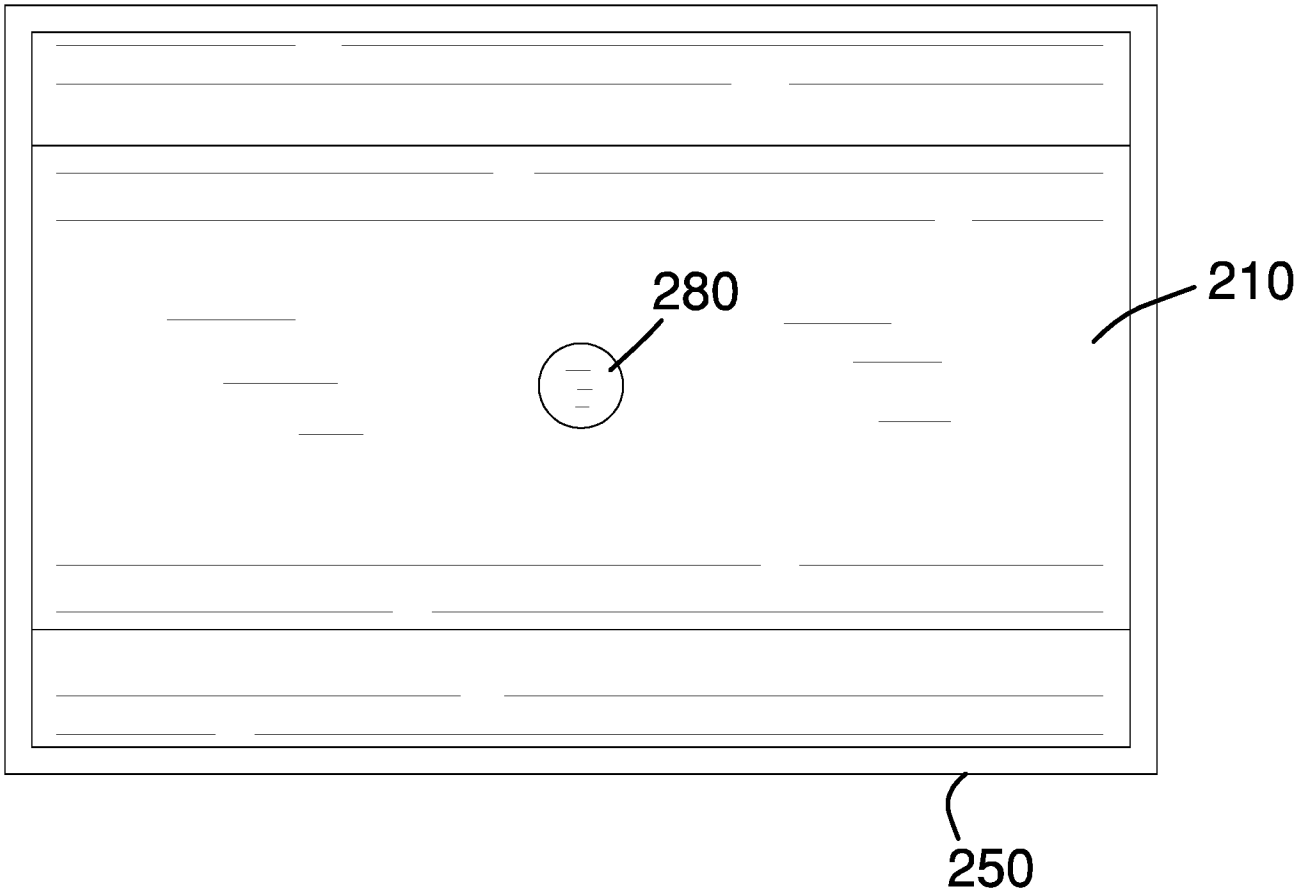
FIG. 4 is a top view of an embodiment of the disclosure.
Figure 5:
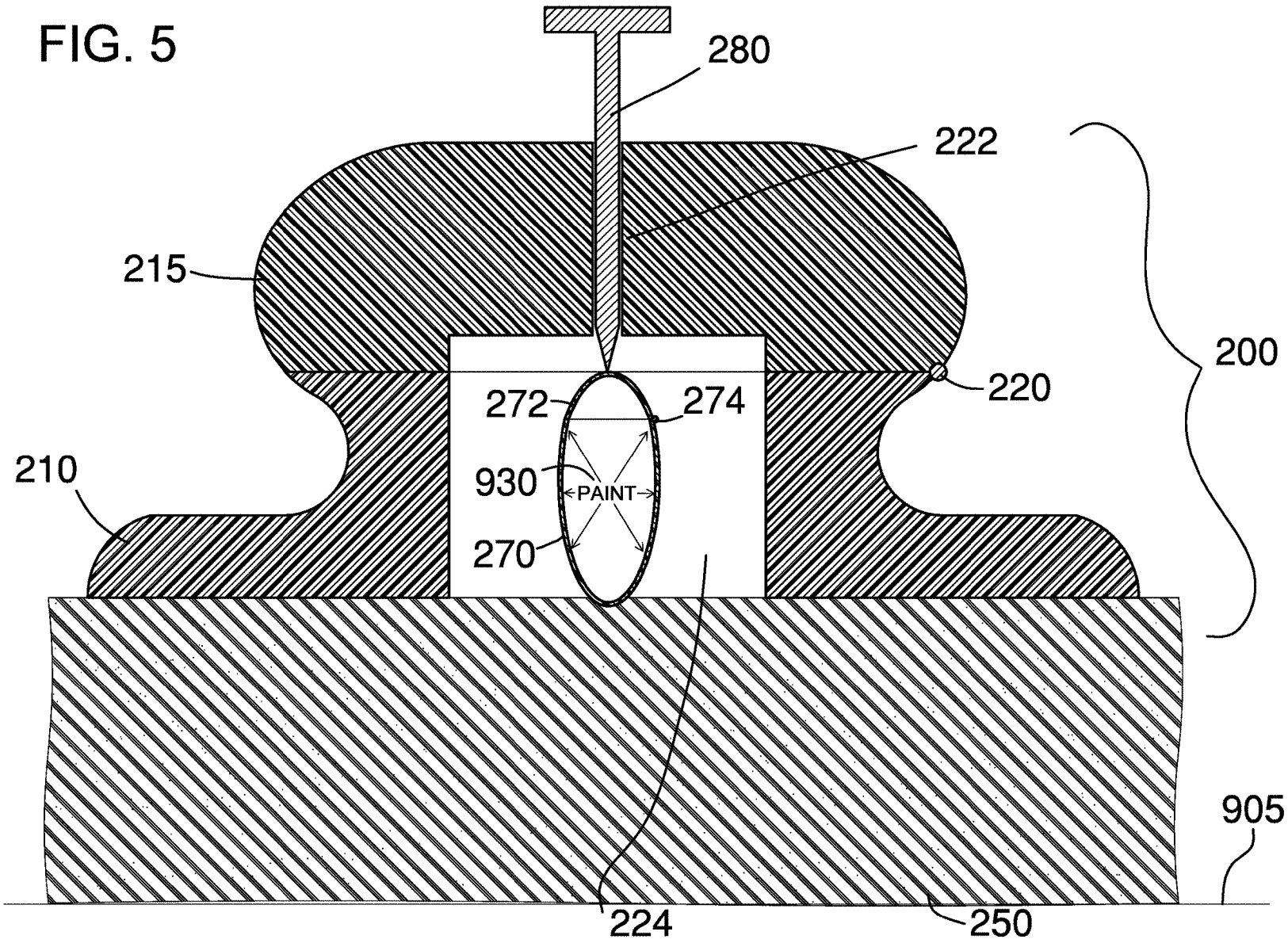
FIG. 5 is a cross-sectional view of an embodiment of the disclosure across 5-5 as shown in FIG. 2.

Detailed reference will now be made to a first potential embodiment of the disclosure, which is illustrated in FIGS. 1 through 5.

The touchup paint applicator system 100 (hereinafter invention) comprises a paint capsule 260, an activator 280, a sponge 250, and a handle 200. The sponge 250 may be operative to clean a surface. As a non-limiting example, the surface may be a wall. The activator 280 may be pressed to pierce the paint capsule 260, releasing paint 930 into the sponge 250. Released paint 935 may be applied to the surface by placing the sponge 250, soaked with the released paint 935, against the surface.

Throughout this document, the orientation of the invention 100 as it is being described is such that the invention 100 is resting on a horizontal surface 905 with the sponge 250 touching the horizontal surface 905. In use, the invention 100 may be reoriented to clean and paint a surface that is vertical, a surface that is horizontal, or a surface that oriented at angles between vertical and horizontal.

The paint capsule 260 may be a container for the paint 930. The paint capsule 260 may be placed into a paint cavity 224 within the handle 200 where it is located below the activator 280. When pressed downwards, the activator 280 may puncture a top of the capsule and a bottom of the capsule, releasing the paint 930 from within the paint capsule 260. The released paint 935 may flow into the sponge 250 and may soak through the sponge 250. The released paint 935 may flow to the bottom of the sponge 250 where it may be applied to the surface by touching the sponge 250 to the surface.

In some embodiments, the paint capsule 260 may comprise a capsule base 270 and a capsule lid 272 that are hingedly coupled via a capsule hinge 274. The paint capsule 260 may be filled with the paint 930 by pivoting the capsule lid 272 to a capsule open position 276, placing the paint 930 into the capsule base 270, and then pivoting the capsule lid 272 to a capsule closed position 278.

The activator 280 may comprise a shaft 282, a head 284, and a point 286. The shaft 282 of the activator 280 may be vertically oriented. The shaft 282 may pass through the top surface of the handle 200 such that the head 284 is located outside of the handle 200 and the point 286 is located within the paint cavity 224 of the handle 200. The point 286 may be located above the paint capsule 260 in the absence of downward pressure on the head 284. When the downward pressure is applied to the head 284, the point 286 may be pressed into the paint capsule 260 and may puncture the paint capsule 260 to release the paint 930.

The sponge 250 may be a tool for cleaning the surface, for absorbing moisture, or for applying the paint 930. The sponge 250 may be made from a porous foam in the shape of a rectangular prism. As non-limiting examples, the sponge 250 may be made from cellulose foam, polyurethane foam, or combinations thereof. In some embodiments, an end of the sponge 250 may be designated for cleaning and drying the surface and the center of the sponge 250 may be designated for applying the paint 930.

The handle 200 may comprise a body 210, a lid 215, and a hinge 220. The handle 200 may be adapted to be gripped by a hand of a user. The bottom of the handle 200 may form a horizontal plane that couples to the top of the sponge 250. The bottom of the handle 200 may be at least 85 percent of the width of the sponge 250 in a front-to-rear direction. The bottom of the handle 200 may be at least 85 percent of the length of the sponge 250 in a side-to-side direction. The top of the handle 200 may have a bulbous shape when viewed from a left side 202 or a right side 204. A front finger groove 230 may run along a front side 206 of the handle 200 from the left side 202 to the right side 204 at a vertical height that places the center of the front finger groove 230 between 25 percent and 75 percent of the height of the handle 200. A rear finger groove 235 may run along a rear side 208 of the handle 200 from the left side 202 to the right side 204 at a vertical height that places the center of the rear finger groove 235 between 25 percent and 75 percent of the height of the handle 200.

The paint cavity 224 may be located within the handle 200. The paint capsule 260 may be placed within the paint cavity 224 and held there until the paint capsule 260 is removed or pierced to release the paint 930.

The body 210 may comprise the bottom of the handle 200. The body 210 may hingedly couple to the lid 215 to form the handle 200 via the hinge 220. A central portion of the body 210 may be open from top to bottom to form the paint cavity 224. When the paint capsule 260 is pierced, the paint 930 may flow into the sponge 250 via a paint aperture 226 at the bottom of the paint cavity 224.

The lid 215 may comprise the top of the handle 200. in some embodiments, the paint cavity 224 may extend upwards into the lid 215. An activator aperture 222 may be a vertically oriented aperture that passes through the lid 215 from top to bottom to provide access to the paint capsule 260 by the activator 280. The lid 215 may be pivoted to a first position 240 to open the lid 215 and provide access to the paint capsule 260. The lid 215 may be pivoted to a second position 245 to close the lid 215 when using the invention 100.

In use, the paint capsule 260 may be opened by pivoting the capsule lid 272 to the capsule open position 276, filling the capsule base 270 with the paint 930, and closed by pivoting the capsule lid 272 to the capsule closed position 278. Alternatively, the paint capsule 260 may have been purchased preloaded with the paint 930 of a desired color. The lid 215 of the handle 200 may be opened by pivoting the lid 215 to the first position 240, exposing the paint cavity 224. The paint capsule 260 may be placed into the paint cavity 224 and the lid 215 may be pivoted to the second position 245 to close the handle 200. The user may grasp the handle 200 and place the sponge 250 against the surface. The surface may be cleaned by moving the sponge 250 over the surface.

As a non-limiting example, the left side 202 of the sponge 250 may be used to wipe away dust before painting. When the surface is clean, the user may hold the invention 100 in a horizontal orientation and press down on the head 284 of the activator 280, causing the point 286 of the activator 280 to pierce the paint capsule 260 within the paint cavity 224. Once pierced, the paint 930 may be released from the paint capsule 260. The released paint 935 may flow down through the paint aperture 226 and into the sponge 250, where it may soak through the sponge 250 to the bottom surface of the sponge 250. The sponge 250 may be placed against the surface and the released paint 935 may be applied to the surface to touch up the surface.

After use, the paint capsule 260 may be removed and discarded. The handle 200 and the sponge 250 may be cleaned and the invention 100 may be reused.

Definitions

Unless otherwise stated, the words "up", "down", "top", "bottom", "upper", and "lower" should be interpreted within a gravitational framework. "Down" is the direction that gravity would pull an object. "Up" is the opposite of "down". "Bottom" is the part of an object that is down farther than any other part of the object. "Top" is the part of an object that is up farther than any other part of the object. "Upper" refers to top and "lower" refers to the bottom. As a non-limiting example, the upper end of a vertical shaft is the top end of the vertical shaft.

As used in this disclosure, an "aperture" is an opening in a surface. Aperture may be synonymous with hole, slit, crack, gap, slot, or opening.

As used in this disclosure, a "cavity" is an empty space or negative space that is formed within an object.

As used herein, the words "couple", "couples", "coupled" or "coupling", refer to connecting, either directly or indirectly, and does not necessarily imply a mechanical connection.

As used herein, the word "desired" refers to a specific value or action within a range of supported values or action. A "desired" value or action indicates that a range of values or actions is enabled by the invention and that a user of the invention may select a specific value or action within the supported range of values or action based upon their own personal preference. As a non-limiting example, for a fan that supports operational speed settings of low, medium, or high, a user may select a desired fan speed, meaning that the user may select low, medium, or high speed based upon their needs and preferences at the time of the selection.

As used in this disclosure, a "handle" is an object by which a tool, object, or door is held or manipulated with the hand.

As used in this disclosure, a "hinge" is a device that permits the turning, rotating, or pivoting of a first object relative to a second object.

As used in this disclosure, "horizontal" is a directional term that refers to a direction that is perpendicular to the local force of gravity. Unless specifically noted in this disclosure, the horizontal direction is always perpendicular to the vertical direction.

As used in this disclosure, a "lid" is a movable or removable cover that is placed on a hollow structure to contain and/or protect the contents within the hollow structure.

As used in this disclosure, "orientation" refers to the positioning and/or angular alignment of a first object relative to a second object or relative to a reference position or reference direction.

As used in this disclosure, a "prism" is a 3 dimensional geometric structure wherein: 1) the form factor of two faces of the prism are congruent; and, 2) the two congruent faces are parallel to each other. The two congruent faces are also commonly referred to as the ends of the prism. The surfaces that connect the two congruent faces are called that lateral faces. In this disclosure, when further description is required a prism will be named for the geometric or descriptive name of the form factor of the two congruent faces. If the form factor of the two corresponding faces has no clearly established or well-known geometric or descriptive name, the term irregular prism will be used. The center axis of a prism is defined as a line that joins the center point of the first congruent face of the prism to the center point of the second corresponding congruent face of the prism. The center axis of a prism is otherwise analogous the center axis of a cylinder. A prism wherein the ends are circles is commonly referred to as a cylinder.

As used in this disclosure, the term "shaft" is used to describe a rigid cylinder. A shaft is often used as the handle of a tool or implement or as the center of rotating machinery or motors. The definition of shaft explicitly includes solid shafts or shafts that comprise a hollow passage through the shaft along the center axis of the shaft cylinder, whether the shaft has one or more sealed ends or not.

As used in this disclosure, a "sponge" is a material, generally with a fibrous structure, that is capable of absorbing and retaining liquids.

As used in this disclosure, a "tool" is a device, an apparatus, or an instrument that is used to carry out an activity, operation, or procedure.

As used in this disclosure, "vertical" refers to a direction that is parallel to the local force of gravity. Unless specifically noted in this disclosure, the vertical direction is always perpendicular to horizontal.

With respect to the above description, it is to be realized that the optimum dimensional relationship for the various components of the invention described above and in FIGS. 1 through 5, include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. A touchup paint applicator system comprising:

a paint capsule, an activator, a sponge, and a handle;

wherein the sponge is operative to clean a surface;

wherein the activator is pressed to pierce the paint capsule, releasing paint into the sponge;

wherein released paint is applied to the surface by placing the sponge, soaked with the released paint, against the surface;

wherein the paint capsule is a container for the paint;

wherein the paint capsule is placed into a paint cavity within the handle where it is located below the activator;

wherein when pressed downwards, the activator punctures a top of the capsule and a bottom of the capsule, releasing the paint from within the paint capsule;

wherein the released paint flows into the sponge and soaks through the sponge;

wherein the released paint flows to a bottom of the sponge where it is applied to the surface by touching the sponge to the surface;

wherein the paint capsule comprises a capsule base and a capsule lid that are hingedly coupled via a capsule hinge;

wherein the paint capsule is filled with the paint by pivoting the capsule lid to a capsule open position, placing the paint into the capsule base, and then pivoting the capsule lid to a capsule closed position.

2. The touchup paint applicator system according to claim 1 wherein the activator comprises a shaft, a head, and a point;

wherein the shaft of the activator is vertically oriented;

wherein the shaft passes through a top surface of the handle such that the head is located outside of the handle and the point is located within the paint cavity of the handle.

3. The touchup paint applicator system according to claim 2 wherein when the downward pressure is applied to the head, the point is pressed into the paint capsule and punctures the paint capsule to release the paint.

4. The touchup paint applicator system according to claim 3 wherein the sponge is a tool for cleaning the surface, for absorbing moisture, or for applying the paint;

wherein the sponge is made from a porous foam in the shape of a rectangular prism.

5. The touchup paint applicator system according to claim 4 wherein the sponge is made from cellulose foam, polyurethane foam, or combinations thereof.

6. The touchup paint applicator system according to claim 4 wherein an end of the sponge is designated for cleaning and drying the surface and the center of the sponge is designated for applying the paint.

7. The touchup paint applicator system according to claim 4 wherein the handle comprises a body, a lid, and a hinge;

wherein the handle is adapted to be gripped by a hand of a user;

wherein a bottom of the handle forms a horizontal plane that couples to the top of the sponge;

wherein the bottom of the handle is at least 85 percent of the width of the sponge in a front-to-rear direction;

wherein the bottom of the handle is at least 85 percent of the length of the sponge in a side-to-side direction.

8. The touchup paint applicator system according to claim 7 wherein the top of the handle comprises a bulbous shape when viewed from a left side or a right side.

9. The touchup paint applicator system according to claim 7 wherein a front finger groove runs along a front side of the handle from a left side to a right side at a vertical height that places the center of the front finger groove between 25 percent and 75 percent of the height of the handle;

wherein a rear finger groove runs along a rear side of the handle from the left side to the right side at a vertical height that places the center of the rear finger groove between 25 percent and 75 percent of the height of the handle.

10. The touchup paint applicator system according to claim 9 wherein the paint cavity is located within the handle;

wherein the paint capsule is placed within the paint cavity and held there until the paint capsule is removed or pierced to release the paint.

11. The touchup paint applicator system according to claim 10 wherein the body comprises the bottom of the handle;

wherein the body hingedly couples to the lid to form the handle via the hinge.

12. The touchup paint applicator system according to claim 11 wherein a central portion of the body is open from top to bottom to form the paint cavity.

13. The touchup paint applicator system according to claim 12 wherein when the paint capsule is pierced, the paint flows into the sponge via a paint aperture at a bottom of the paint cavity.

14. The touchup paint applicator system according to claim 13 wherein the lid comprises the top of the handle.

15. The touchup paint applicator system according to claim 14 wherein the paint cavity extends upwards into the lid.

16. The touchup paint applicator system according to claim 14 wherein an activator aperture is a vertically oriented aperture that passes through the lid from top to bottom to provide access to the paint capsule by the activator.

17. The touchup paint applicator system according to claim 16 wherein the lid is pivoted to a first position to open the lid and provide access to the paint capsule;

wherein the lid is pivoted to a second position to close the lid when using the touchup paint applicator system.

* * * * *